US009964331B2

(12) United States Patent
Chen

(10) Patent No.: US 9,964,331 B2
(45) Date of Patent: May 8, 2018

(54) INSTANTANEOUS HEATER

(71) Applicant: Jianliang Chen, Fuzhou (CN)

(72) Inventor: Jianliang Chen, Fuzhou (CN)

( * ) Notice: Subject to any disclaimer, the term of this patent is extended or adjusted under 35 U.S.C. 154(b) by 256 days.

(21) Appl. No.: 14/888,079

(22) PCT Filed: Jul. 22, 2015

(86) PCT No.: PCT/CN2015/084739

§ 371 (c)(1),
(2) Date: Oct. 29, 2015

(87) PCT Pub. No.: WO2016/197434

PCT Pub. Date: Dec. 15, 2016

(65) Prior Publication Data

US 2017/0227253 A1 Aug. 10, 2017

(30) Foreign Application Priority Data

Jun. 8, 2015 (CN) ..... 2015 1 0308599

(51) Int. Cl.
*F24H 1/10* (2006.01)
*F24H 1/12* (2006.01)

(52) U.S. Cl.
CPC ..... *F24H 1/101* (2013.01); *F24H 1/121* (2013.01)

(58) Field of Classification Search
None
See application file for complete search history.

(56) References Cited

U.S. PATENT DOCUMENTS 1,188,952 A * 6/1916 Laird ..... F24H 1/102 392/473
1,318,237 A * 10/1919 Sordi ..... F24H 1/102 122/4 A
1,437,046 A * 11/1922 Domiguez ..... F24H 1/102 392/489
1,519,395 A * 12/1924 Clench ..... F24H 1/102 392/480
1,671,677 A * 5/1928 Keeton ..... F24H 1/142 392/489
1,767,122 A * 6/1930 Dean ..... F24H 1/142 392/483
1,985,830 A * 12/1934 Powers ..... F24H 1/102 392/471
2,438,865 A * 3/1948 Rehard ..... F24H 1/102 392/489

(Continued)

*Primary Examiner* — Thor Campbell
(74) *Attorney, Agent, or Firm* — Stein IP, LLC

(57) ABSTRACT

The present invention relates to an instantaneous heater, comprising a heating assembly, wherein the heating assembly includes a heating element, a first shell, a first inlet tube, a first water outlet, a hot water cavity, a cold water cavity and a capillary tube, the hot water cavity is in the first shell, the heating element is in the hot water cavity, the hot water cavity communicates with the cold water cavity, the first inlet tube communicates with the cold water cavity, the first water outlet is on the top of the first shell and communicates with the hot water cavity, the capillary tube is in the cold water cavity, one end of the capillary tube communicates with the hot water cavity and the other end communicates with the outside of the first shell. The instantaneous heater boasts simple structure, low cost and effective prevention of vapor from rapidly erupting.

9 Claims, 8 Drawing Sheets

(56) References Cited

U.S. PATENT DOCUMENTS

| | | | | | |
|---|---|---|---|---|---|
| 2,775,683 | A * | 12/1956 | Kleist | F25B 43/00 | 222/146.3 |
| 3,777,117 | A * | 12/1973 | Othmer | F24H 1/121 | 137/341 |
| 4,286,140 | A * | 8/1981 | Dewulf | F24H 1/142 | 165/156 |
| 4,395,618 | A * | 7/1983 | Cunningham | F24H 1/102 | 165/160 |
| 4,563,571 | A * | 1/1986 | Koga | F24H 1/102 | 219/543 |
| 5,400,432 | A * | 3/1995 | Kager | F24H 1/102 | 165/160 |
| 6,144,802 | A * | 11/2000 | Kim | F24H 1/102 | 392/479 |
| 6,621,984 | B2 * | 9/2003 | Castaneda | F24H 1/142 | 392/465 |
| 7,003,221 | B2 * | 2/2006 | Tsujimura | B65D 85/66 | 392/491 |
| 7,593,625 | B2 * | 9/2009 | Kamikawa | F24H 1/101 | 392/393 |
| 7,959,090 | B2 * | 6/2011 | Shank | B05B 9/002 | 239/130 |
| 9,014,548 | B2 * | 4/2015 | Jang | F24H 1/0018 | 392/465 |
| 2015/0327720 | A1 * | 11/2015 | Blanc | A47J 31/542 | 392/493 |

* cited by examiner

INSTANTANEOUS HEATER

CROSS-REFERENCE TO RELATED APPLICATIONS

This application is a national stage of International Application No. PCT/CN2015/084739, filed Jul. 22, 2015, which claims the benefit of priority to Chinese Application No. 201510308599.X, filed Jun. 8, 2015, in the State Intellectual Property Office, the disclosures of which are incorporated herein by reference.

TECHNICAL FIELD

The present invention relates to a liquid heating appliance, more especially to an instantaneous heater.

DESCRIPTION OF RELATED ART

With the improvement of living standard's, people expect increasingly high requirements for the safety and health of drinking water. Drinking water appliances available on the market currently require water heat preservation after heating water in the container, and repeatedly heat water for maintaining the necessary temperature due to water temperature decrease along with the use of hot water. Moreover, frequent filling with water is also required during use, being very inconvenient, so instantaneous heater products have come into being. However, instantaneous heaters have a high requirement for the temperature rise after short-term heating. Under certain heating power condition, the water volume in the heating cup is at its minimum in order to heat the water flowing through the heating cup to the boiling point. Therefore, when a sudden power failure or water cut-off occurs during the operation of the heater, without the continuous entry of cold water into the heating cup, the water left in the cup almost at the boiling point will be heated to over 100° C. instantaneously under the action of the residual heat of the heating rod, the remaining water will be completely gasified to vapor which may erupt rapidly from the water outlet, introducing the hidden danger of personal scalding. In addition, when instantaneous heaters are working, water vapor and water flows out together. Splashing and interruption of the water flow may occur due to the influence of water vapor, presenting a potential safety hazard.

A Chinese patent (Patent Application No.: 200610040207.7) discloses an electric energy-saving instant-heating water heater device, comprising a water tank, a connecting tube, a water control valve, a quartz glass coated spiral tube heater and water-vapor separator, and also comprising an electric heater device composed of a vapor heat recovery heat exchanger for providing hot water at a certain temperature. The patent above overcomes the defect of the drinking fountains and water boilers in the prior art where a large amount of vapor may be discharged during heating, designs a quartz glass coated spiral tube heater to heat water, which enables the heated water vapor to enter the vapor heat recovery heat exchanger to perform heat exchanging with the water in the water tube of the heater, thus reducing heat loss during vapor discharging. Namely, the patent above uses a vapor heat recovery heat exchanger and a water-vapor separator to perform heat exchanging so as to realize the effect of full utilization of energy. However, the patent above has the defects of complicated structure and high cost.

Technical Problems

The technical problem to be solved by the present invention is: to provide an instantaneous heater with simple structure capable of preventing liquid vapor from rapidly erupting.

Solutions to the Problem

Technical Solutions

To address the technical problem above, the present invention provides the following technical solution:

an instantaneous heater, comprising a heating assembly, wherein the assembly is composed of a heating element, a first shell, a first inlet tube, a first water outlet, a hot water cavity, a cold water cavity and a capillary tube, the hot water cavity is arranged in the first shell, the heating element is arranged in the hot water cavity, the hot water cavity communicates with the cold water cavity, the first inlet tube communicates with the cold water cavity, the first water outlet is mounted on the top of the first shell and communicates with the hot water cavity, the capillary tube is arranged in the cold water cavity, one end of the capillary tube communicates with the hot water cavity and the other end communicates with the outside of the first shell.

Beneficial Effects of the Invention

Beneficial Effects

The beneficial effects of the instantaneous heater for the present invention are as below:

the design comprises a heating assembly composed of a first shell, a first inlet tube, a first water outlet, a hot water cavity, a cold water cavity and a capillary tube, wherein the capillary tube is arranged in the cold water cavity, one end of the capillary tube communicates with the hot water cavity and the other end communicates with the outside of the first shell, in this way, when the pressure in the hot water cavity is too high, the capillary tube can guide the water vapor in the hot water cavity and pass the heat in the water vapor to the cold water in the cold water cavity to allow the water vapor to condense, thus achieving a throttling and pressure reduction effect, and further obtaining the beneficial effect of preventing vapor from rapidly erupting from the first water outlet; the cold water in the cold water cavity can also be pre-heated, avoiding energy loss; furthermore, the design has the advantages of simple structure and low cost.

BRIEF DESCRIPTION OF THE DRAWINGS

BRIEF DESCRIPTION OF THE SEVERAL VIEWS OF THE DRAWINGS

Figure 1:
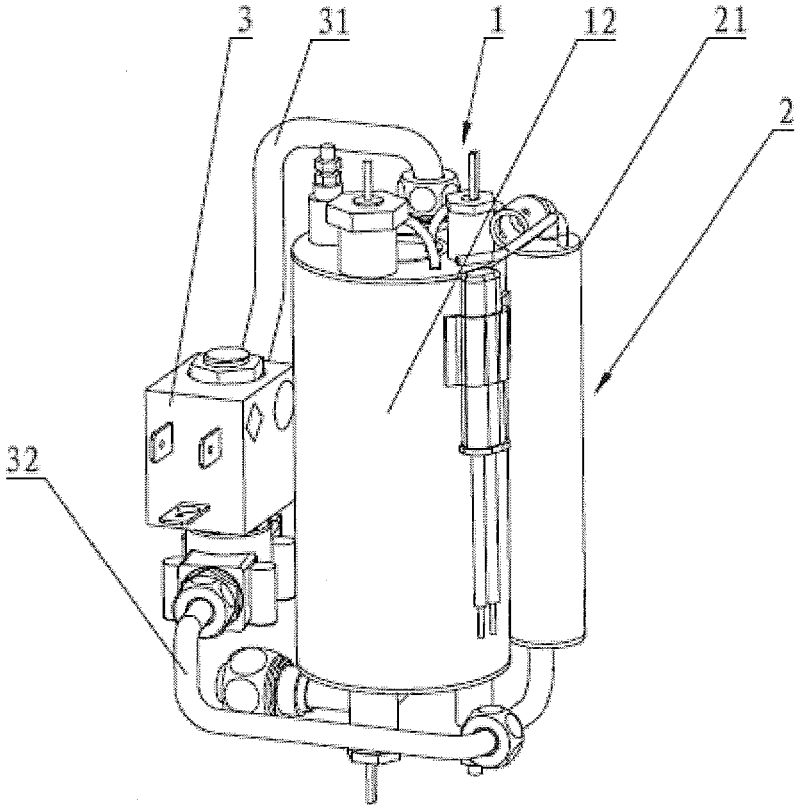
Figure 2:
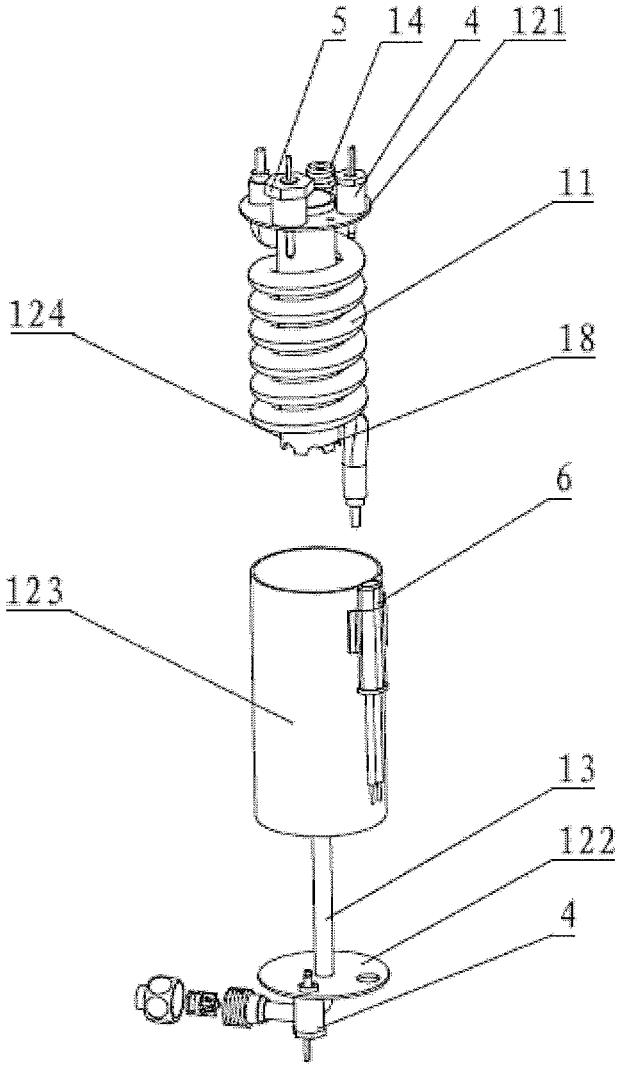
Figure 3:
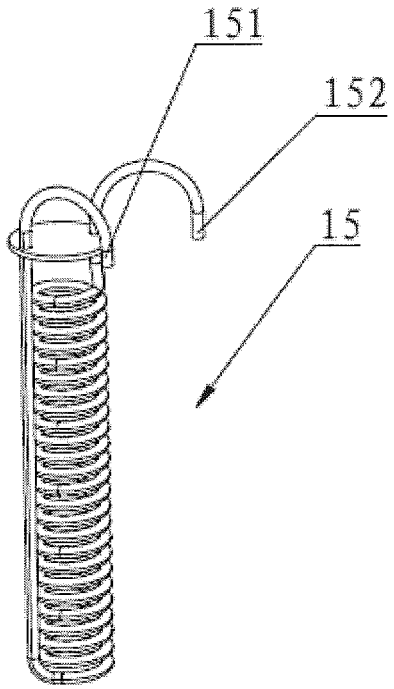
Figure 4:
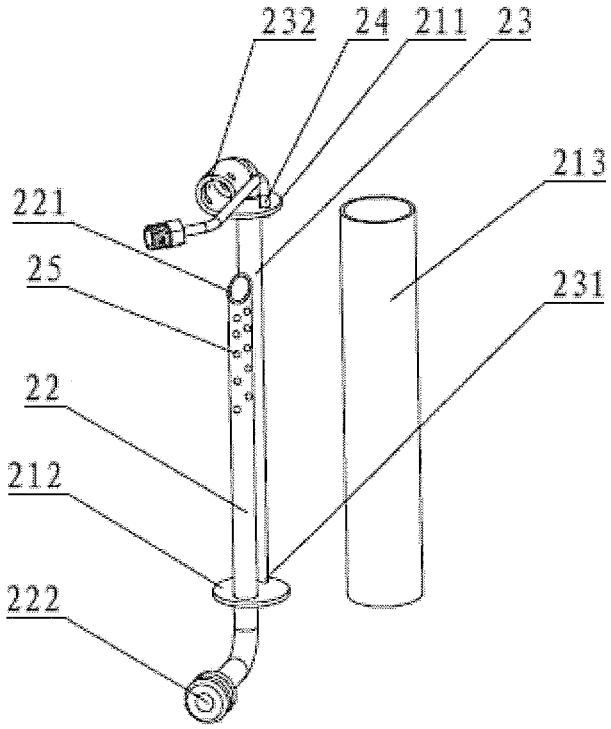
Figure 5:
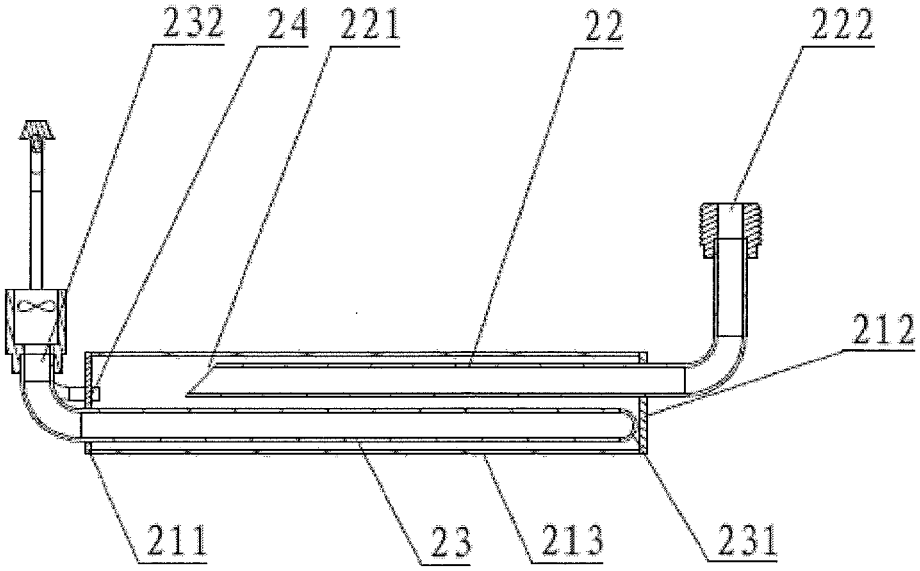
Figure 6:
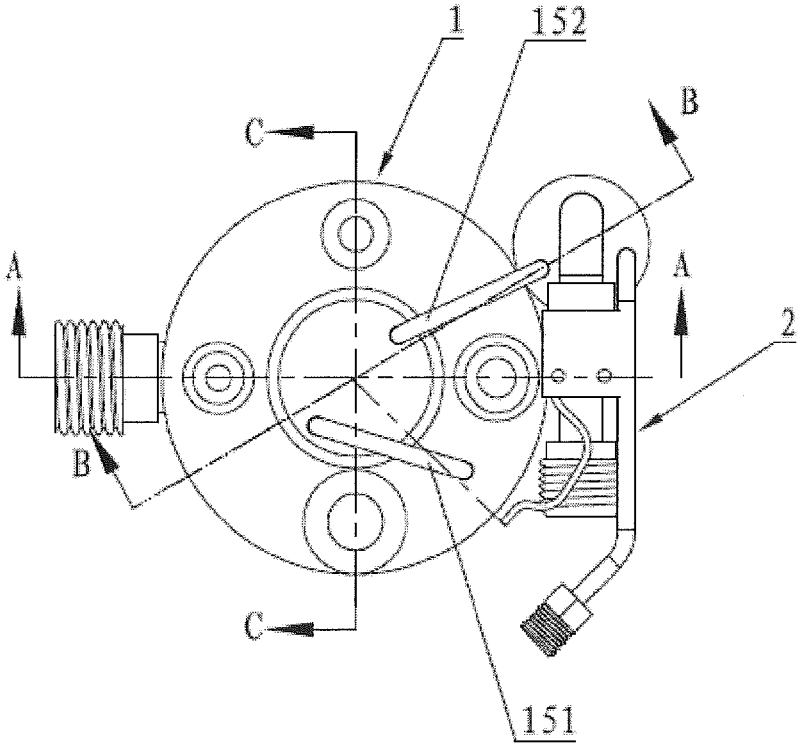
Figure 7:
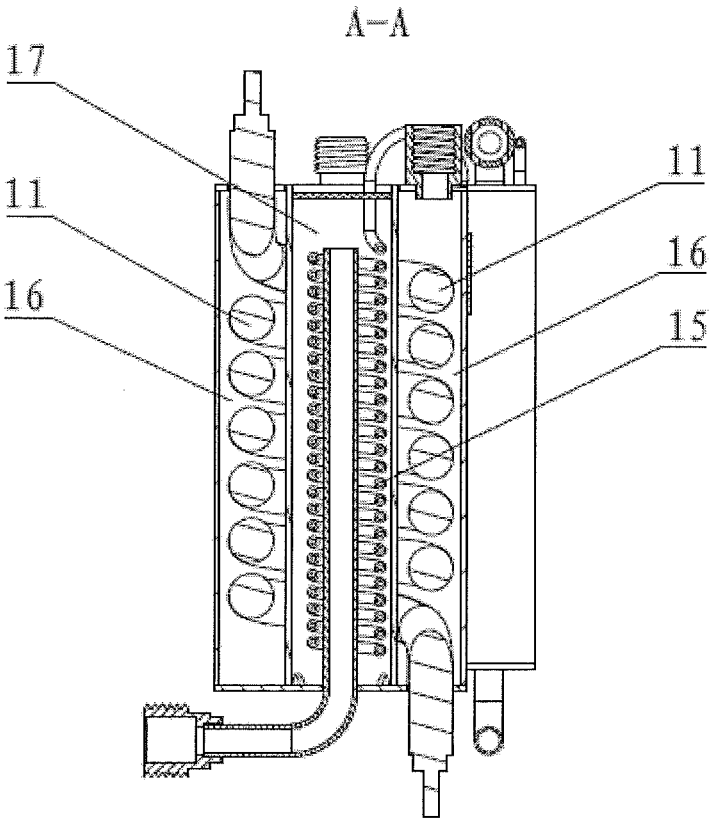
Figure 8:
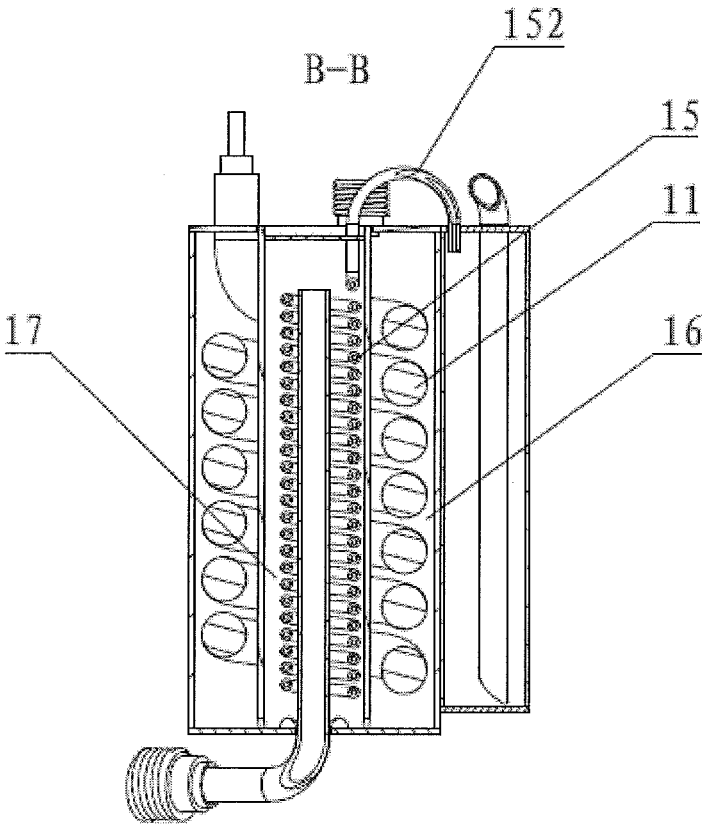
Figure 9:
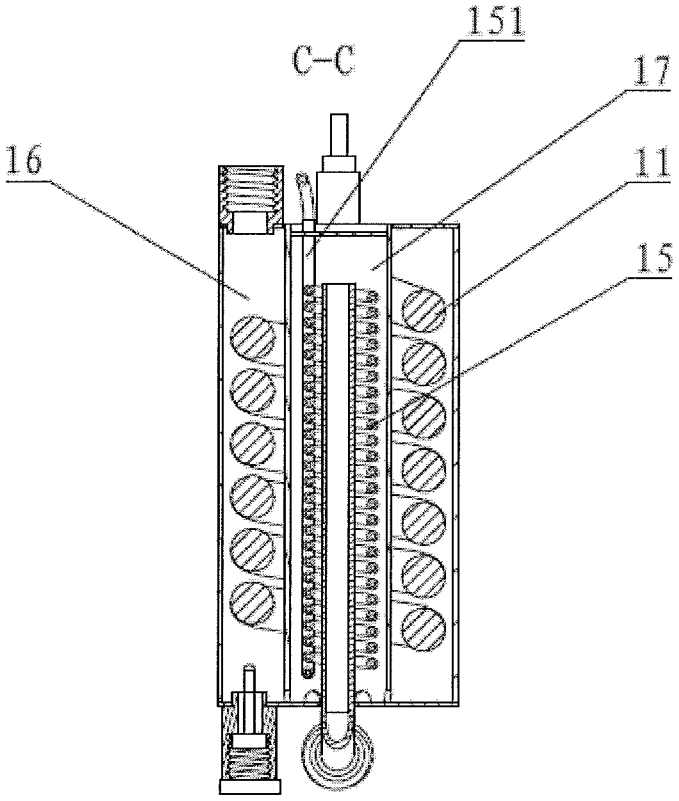

FIG. 1 shows the view of the three-dimensional structure of the instantaneous heater according to the embodiments of the present invention;

FIG. 2 shows the view of the three-dimensional structure of the heating assembly for the instantaneous heater according to the embodiments of the present invention;

FIG. 3 shows the view of the three-dimensional structure of the capillary tube for the instantaneous heater according to the embodiments of the present invention;

FIG. 4 shows the view of the three-dimensional structure of the buffer assembly for the instantaneous heater according to the embodiments of the present invention;

FIG. 5 shows the view of the longitudinal section of the buffer assembly for the instantaneous heater according to the embodiments of the present invention;

FIG. 6 shows the bottom view of the instantaneous heater according to the embodiments of the present invention;

FIG. 7 shows the sectional view along the A-A direction of the instantaneous heater according to the embodiments of the present invention;

FIG. 8 shows the sectional view along the B-B direction of the instantaneous heater according to the embodiments of the present invention;

FIG. 9 shows the sectional view along the C-C direction of the instantaneous heater according to the embodiments of the present invention.

BRIEF DESCRIPTION OF THE REFERENCE NUMERALS OF MAJOR COMPONENTS

1. heating assembly; 11. heating element; 12. first shell; 121. first upper cover; 122. first lower cover; 123. first outer tube; 124. inner tube; 13. first inlet tube; 14. first water outlet; 15. capillary tube; 151. one end of the capillary tube; 152. the other end of the capillary tube; 16. hot water cavity; 17. cold water cavity; 18. first through hole; 2. buffer assembly; 21. second shell; 211. second upper cover; 212. second lower cover; 213. second outer tube; 22. second inlet tube; 221. water outlet of the second inlet tube; 222. water inlet of the second inlet tube; 23. second outlet tube; 231. water inlet of the second outlet tube; 232. water outlet of the second outlet tube; 24. air outlet; 25. second through hole; 3. solenoid valve; 31. inlet of the solenoid valve; 32. outlet of the solenoid valve; 4. temperature sensor; 5. liquid level sensor; 6. heat breaker.

Embodiments of the Invention

DETAILED DESCRIPTION OF THE INVENTION

The technical contents, expected purposes, and effects of the present invention are detailed hereinafter in combination with the embodiments and drawings.

The key concept of the present invention is the capillary tube which passes heat in the hot water cavity into the cold water cavity so as to avoid the safety problem caused by vapor rapidly erupting.

As shown in FIGS. 1~9, an instantaneous heater according to the present invention, comprising a heating assembly 1, wherein the assembly 1 is composed of a heating element 11, a first shell 12, a first inlet tube 13, a first water outlet 14, a hot water cavity 16, a cold water cavity 17 and a capillary tube 15, the hot water cavity 16 is arranged in the first shell 12, the heating element 11 is arranged in the hot water cavity 16, the hot water cavity 16 communicates with the cold water cavity 17, the first inlet tube 13 communicates with the cold water cavity 17, the first water outlet 14 is mounted on the top of the first shell 12 and communicates with the hot water cavity 16, the capillary tube 15 is arranged in the cold water cavity 17, one end of the capillary tube 151 communicates with the hot water cavity 16 and the other end 152 communicates with the outside of the first shell 12.

According to the description above, the beneficial effects of the present invention are as below:

the design comprises a heating assembly composed of a first shell, a first inlet tube, a first water outlet, a hot water cavity, a cold water cavity and a capillary tube, wherein the capillary tube is arranged in the cold water cavity, one end of the capillary tube communicates with the hot water cavity and the other end communicates with the outside of the first shell, in this way, when the pressure in the hot water cavity is too high, the capillary tube can guide the water vapor in the hot water cavity and pass the heat in the water vapor to the cold water in the cold water cavity to allow the water vapor to condense, thus achieving a throttling and pressure reduction effect, and further obtaining the beneficial effect of preventing vapor from rapidly erupting from the first water outlet; the cold water in the cold water cavity can be also pre-heated, avoiding energy loss; furthermore, the design has the advantages of simple structure and low cost.

Furthermore, the capillary tube 15 is a threaded type.

According to the description above, when the capillary tube is a threaded type, the capillary tube length is greatly enlarged and the resistance is increased so as to prevent the water vapor in the hot water cavity during working from passing through the threaded capillary tube.

Furthermore, the location where the hot water cavity 16 communicates with the cold water cavity 17 is near the bottom of the first shell 12, and the location where one end 151 of the capillary tube communicates with the hot water cavity 16 is near the top of the first shell 12.

According to the description above, the cold water in the cold water cavity flows from the location near the bottom of the first shell into the hot water cavity to heat so that the cold water fills the hot water cavity in the direction from the bottom of the first shell to the top of the first shell; when the location where one end of the capillary tube communicates with the hot water cavity is near the top of the first shell, the vapor in the top of the first shell can be guaranteed to effectively enter the capillary tube.

Furthermore, the first shell 12 includes a first upper cover 121, a first lower cover 122, a first outer tube 123 and an inner tube 124, wherein the inner tube 124 is arranged in the first outer tube 123, the first upper cover 121 and the first lower cover 122 are arranged on the both ends of the first outer tube 123 or the inner tube 124 respectively, the hot water cavity 16 is defined by the first upper cover 121, the first lower cover 122, the first outer tube 123 and the inner tube 124, the cold water cavity 17 is defined by the first upper cover 121, the first lower cover 122 and the inner tube 124, and one or more first through holes 18 are arranged at the bottom of the inner tube 124.

According to the description above, the design of the above-mentioned structure leads to a U-shaped tube structure between the cold water cavity and the hot water cavity, and the water in the cold water cavity can absorb part of the heat on the top of the hot water cavity so as to reduce the generation of water vapor on the top of the hot water cavity, namely, the above-mentioned U-shaped tube structure, thus realizing pre-heating and reduction of the generation of water vapor on the top of the hot water cavity.

Furthermore, the water outlet of the first inlet tube 13 is arranged on the upper part of the cold water cavity 17.

According to the description above, the design where the water outlet of the first inlet tube is arranged on the upper part of the cold water cavity allows cold water to flow from the upper part of the cold water cavity into the cold water cavity, and further flow from the bottom of the cold water cavity into the hot water cavity.

Furthermore, also comprising a buffer assembly 2, wherein the buffer assembly 2 includes a second shell 21, a second inlet tube 22, a second outlet tube 23 and an air outlet 24, the second inlet tube 22 extends from the bottom of the second shell 21 into the second shell 21, the water outlet 221 of the second inlet tube is in the middle or in the upper part of the second shell 21, the second outlet tube 23 extends from the top of the second shell 21 into the second shell 21, the water inlet 231 of the second outlet tube is in the lower part of the second shell 21, and the air outlet 24 is arranged on the top of the second shell 21;

the water inlet 222 of the second inlet tube communicates with the first water outlet 14, the water outlet 221 of the second inlet tube is away from the air outlet 24 a certain distance in the vertical direction, and the water outlet 232 of the second outlet tube communicates with the outside of the second shell 21.

According to the description above, the water outlet of the second inlet tube of the buffer assembly is in the middle-upper part of the second shell and the water inlet of the second outlet tube is at the bottom of the shell, in this way, a certain height difference is formed between the water outlet of the second inlet tube and the water inlet of the second outlet tube, and a certain height difference is also formed in the vertical direction between the water outlet of the second inlet tube and the air outlet, thus, when the instantaneous heater heats water and discharges the resultant water normally, the boiled water mixed with water vapor flows from the hot water cavity into the buffer assembly through the water outlet of the second inlet tube to perform water-vapor separation and air removal. Afterwards, the boiled water flows downwards through the water outlet of the second inlet tube under the action of self gravity, and when the boiled water flows downwards, the pressure of the water releases thus outputting water from the second outlet tube by relying on the action of gravity only so as to achieve the effect of the reduction of water flowing-out speed; meanwhile, when the boiled water flows downwards, water vapor is separated from the water, moves upwards, and then is discharged from the air outlet, thus, it is not affected by the pressure in the heating assembly, the water output is soft, preventing hot water from splashing.

Furthermore, the water outlet 221 of the second inlet tube is sealed, and one or more second through holes 25 are arranged in the wall of the second inlet tube 22.

According to the description above, the design of the above-mentioned structure enables the boiled water flowing out from the second inlet tube to impact on the second shell rather than directly fall off, and under the action of gravity and viscous force on the water surface, the water will flow downwards along the second shell, while the water vapor will be separated from the water after impact, move upwards, and then be discharged from the air outlet, so as to play a role in the water-vapor separation.

Furthermore, the caliber of the air outlet 24 is smaller than the inner diameter of the second outlet tube 23 so that the liquid resistance generated by the air outlet 24 toward the liquid in the second shell 21 is sufficient to prevent the liquid from flowing out from the air outlet 24.

According to the description above, the caliber of the air outlet on the buffer is much smaller than the inner diameter of the second outlet tube, in this way, the air outlet generates high water resistance toward the water, thus the vapor is easily discharged while the hot water is not apt to flow out from the air outlet.

Furthermore, also comprising a solenoid valve 3, wherein the inlet 31 of the solenoid valve communicates with the first water outlet 14, and the outlet 32 of the solenoid valve communicates with the second inlet tube 22.

According to the description above, the solenoid valve can be used to realize the control of water direction, flow rate, speed, and other parameters.

Furthermore, also comprising a temperature sensor 4, a liquid level sensor 5, a flow sensor and a heat breaker 6, wherein the detecting points of the temperature sensor 4 extend into the hot water cavity 16 and the cold water cavity 17 respectively, the detecting points of the liquid level sensor 5 and the heat breaker 6 extend into the hot water cavity 16 respectively, and the detecting point of the flow sensor extends into the first inlet tube 13.

According to the description above, the detecting point of the temperature sensor can penetrate into the hot water cavity for monitoring the temperature of the liquid in the hot water cavity in real time. Moreover, a liquid level sensor can be arranged on the upper part of the first shell, in this way, when the instantaneous heater suffers the fault of lack of water, the heating element can be powered off in time and a warning indication will be given to avoid device damage due to dry burning of the heating element. Moreover, a heat breaker can be arranged on the upper part of the first shell, in this way, when the electrically controlled system suffers a fault, the whole device can be powered off to make sure of the safety of the device. The temperature sensor can be also arranged near the first inlet tube to guarantee that cold water entering the hot water cavity can be measured in time so that the electrically controlled system can accurately control the heating power of the heating element.

As shown in FIGS. 1 to 9, Embodiment 1 according to the present invention is described as below.

The instantaneous heater in the embodiment is composed of three parts: a heating assembly 1, a solenoid valve 3 and a buffer assembly 2. Wherein the heating assembly 1 includes a first outer tube 123, an inner tube 124, a first lower cover 122, a first upper cover 121, a heating element 11, a first inlet tube 13, a first water outlet 14 and a capillary tube 15. The heating element 11 can be a simple heating rod structure such as a threaded heating rod. The two ends of the capillary tube 15 can be fixed onto the same cover so as to facilitate the fixation and displacement of the capillary tube 15. The inner tube 124 passes through the middle of the heating element 11, the two ends of the heating element 11 are welded on the through holes in the first upper cover 121 and the first lower cover 122, the two ends of the inner tube 124 are welded together with the big through holes in the middle of the first lower cover 122 and the first upper cover 121 respectively, and the first outer tube 123 is welded with the outer edge of the first upper cover 121 and the first lower cover 122, constituting the main body of the heating assembly, wherein the cavity formed by the inner tube 124 is the cold water cavity 17, and the cavity where the heating element 11 lies is hot water cavity 16. The first inlet tube 13 is inserted into inner tube 124 after passing capillary tube 15, and welded onto the first lower cover 122, while capillary tube 15 is welded onto the same cover, then accommodated in the inner tube 124 as a whole and welded for fixation. One end of capillary tube 151 is welded with the first upper cover 121 after passing the first upper cover 121, and the other end of capillary tube 152 is connected with the upper part of the second shell 21 of the buffer. The water outlet of the first inlet tube 13 is arranged near the cover fixing the both ends of the capillary tube and on the upper part of the first shell 12. The opening shape of the water outlet of the first inlet tube 13 is not limited. One or more first through holes 18 are opened at the bottom of the inner tube 124. After welding with the first lower cover, the through holes can make the cold water cavity 17 and the hot water cavity 16 interconnected so that cold water cavity 17 and hot water cavity 16 in the heating assembly 1 form a U-shaped tube structure. A one-way valve is arranged at the water inlet of the first inlet tube 13.

A first water outlet 14 and a temperature sensor 4 are arranged on the first upper cover 121. The detecting point of the temperature sensor 4 penetrates into the hot water cavity 16 for monitoring the temperature of the liquid in the hot water cavity in real time. Moreover, a liquid level sensor 5 can be also arranged on the first upper cover 121, in this way, when the heating assembly 1 suffers the fault of lack of water, the heating element 11 can be powered off in time and a warning indication will be given to avoid the device damage due to dry burning of the heating element 11. Moreover, a heat breaker 6 can be arranged on the upper part of the first shell 12, in this way, when the electrically controlled system suffers a fault, the whole device can be powered off to ensure the safety of the device. An inlet water temperature sensor 4 can be also arranged on the first lower cover 122, and the location shall be just opposite to the opening at the bottom of the inner tube 124 so as to accurately measure the temperature of the cold water entering the hot water cavity 16 in time, thus the electrically controlled system can accurately control the heating power of the heating element 11.

The inlet 31 of the solenoid valve is fluidly connected with the first water outlet 14 via a soft or hard tube capable of bearing pressure; the outlet 32 of the solenoid valve is connected with the second inlet tube 22 of the buffer assembly 2. The buffer assembly 2 includes a second shell 21, a second inlet tube 22, a second outlet tube 23 and an air outlet 24. The second shell 21 can be a closed shell structure encircled by a second outer tube 213, a second upper cover 211 and a second lower cover 212, wherein the second outlet tube 23 and the air outlet 24 are welded together with the second upper cover 211, the second outlet tube 23 penetrates up to the bottom of the buffer tube, and the water inlet 231 of the second outlet tube is preferably obliquely cut opening which is easy to position when assembly and without influence onto water flowing out. The second inlet tube 22 can be welded onto the second outer tube 213, the second upper cover 211 or the second lower cover 212 optionally according to actual assembly needs, but in any case, the water outlet 221 of the second inlet tube shall be guaranteed to be in the middle-upper part of the buffer assembly 2, in this way, a certain height difference is ensured between the water outlet 221 of the second inlet tube and the water inlet 231 of the second outlet tube as well as the air outlet 24. Moreover, the water outlet 221 of the second inlet tube can be different cut opening shapes, but preferably sealed on the top of the water outlet. One or more second through holes 25 can be opened on the side wall of the second inlet tube 22 so that the entering water impacts on the wall of the buffer tube rather than directly falls off. Under the action of gravity and viscous force on the water surface of the hot water and the vapor, the water will flow downwards along the wall, while the water vapor will be separated from the water after impact, move upwards and then be discharged from the air outlet 24, so as to play a role in the water-vapor separation. When the water flows downwards along the wall of the buffer tube, the pressure releases thus outputting water from the second outlet tube 23 by relying on the action of gravity only so as to achieve the effect of the reduction of water flowing-out speed. Moreover, the caliber of the air outlet 24 is much smaller than the inner diameter of the second outlet tube 23, in this way, the air outlet 24 generates high water resistance toward the water, thus the vapor is easily discharged while hot water is not apt to flow out from the air outlet 24.

The water outlet 221 of the second inlet tube is in the middle-upper part of the buffer assembly 2, and the water inlet 231 of the second outlet tube is at the bottom of the buffer assembly 2. There is a certain height difference between them, and also a certain height difference between the water outlet 221 of the second inlet tube and air outlet 24. The beneficial effects of such design are as below: when the instantaneous heater heats water and discharges the resultant water normally, the boiled water mixed with the water vapor and flows into the buffer assembly 2 to perform water-vapor separation and air removal, afterwards, the boiled water flows downwards and enters the second outlet tube 23 to be output outside under the action of self gravity, and vapor is discharged from air outlet 24, and thus, is not affected by the pressure in the heating assembly 1, water output is soft, preventing hot water from splashing. The cold water cavity 17 and hot water cavity 16 form a U-shaped tube structure, and the water in the cold water cavity 17 can absorb part of the heat on the top of hot water cavity 16 so as to reduce the generation of water vapor on the top of hot water cavity 16. Capillary tube 15 is connected with hot water cavity 16, in this way, when the pressure in hot water cavity 16 is too high, the capillary tube can guide the water vapor, thus achieving a throttling and pressure reduction effect, and pass the heat in the water vapor to the cold water in cold water cavity 17 to allow the water vapor to condense, preventing personal injury due to vapor rapidly erupting, and further pre-heat the cold water, avoiding energy loss.

Moreover, a pre-heating coil can be arranged around the periphery of the first shell 12, then cold water is introduced into the pre-heating coil, and flows into cold water cavity 17 via the pre-heating coil and then enters hot water cavity 16, thus, on the one hand, avoiding over high temperature of the first shell 12, on the other hand, making full use of the energy by preheating the cold water flowing into cold water cavity 17 to some extent; alternatively, a pre-heating cavity can be used to replace the pre-heating coil, namely, a pre-heating cavity is arranged outside the first shell 12 (simple cavity structure acceptable), then cold water is introduced into the pre-heating cavity, and flows into cold water cavity 17 via the pre-heating cavity and then enters hot water cavity 16, thus avoiding over high temperature of the first shell 12 and realizing pre-heating of the cold water. The arrangement of the pre-heating coil and pre-heating cavity structure can also lower the internal temperature of the heating assembly 1 and the overall instantaneous heater.

The cold water cavity 17 can be either arranged in the first shell 12, or outside the first shell 12 as a separated part, but the latter design may complicate tube connection and increase production cost.

The first shell 12 and the second shell 21 can be made of welded metals such as copper, stainless steel, or high-strength plastic materials resistant to high temperature. It depends on different purposes. Food-class stainless steel is preferable for the instantaneous heater.

By referring to FIGS. 1 to 9, the specific working principles of the present invention are described as below.

The instantaneous heater in the embodiment is a vertically installed type. Water enters from the first inlet tube 13 at the bottom of the heating assembly 1, flows from the first inlet tube 13 into the cold water cavity 17 via the one-way valve, then enters the hot water cavity 16 via the opening at the bottom of the inner tube 124, and flows out from the first water outlet 14 after being heated to boiling water through heating element 11 during upward movement, afterwards, it enters from the second inlet tube 22 of the buffer assembly 2 via the solenoid valve 3. Upon water-vapor separation in the buffer assembly 2, boiled water can flow out from the second outlet tube 23 and vapor is discharged from the air outlet 24. Since the threaded capillary tube 15 has a long length and high resistance, during normal working, water vapor in hot water cavity 16 can scarcely pass through the threaded capillary tube, hardly affecting the boiled water in the buffer assembly 2. The temperature of the boiled water measured by temperature sensor 4 on the top of the heating assembly 1 will also not exceed 100° C.

However, when sudden water cut-off occurs and no cold water enters the heating assembly 1 continuously, the temperature sensor 4 on the top can immediately detect that the temperature is higher than 100° C. To avoid misjudgment, it can be set so that when the temperature is higher than 102° C., or the flow sensor of the first inlet tube 13 of the heating assembly 1 detects no water flowing signal, or the liquid level sensor 5 detects no sufficient water in the heating assembly 1, the electrically controlled system will automatically switch off the working power of the solenoid valve 3 and the heating element 11 so that the water vapor higher than 100° C. in the heating assembly cannot flow from the first water outlet 14 into the buffer assembly 2 smoothly and eject outside the instantaneous heater. The one-way valve on the first inlet tube 13 also prevents boiled water and water vapor from flowing out from the first inlet tube 13. At this time, the pressure in the heating assembly 1 will increase, the high-temperature water vapor in the hot water cavity 16 will enter into the capillary tube 15, and a throttling and pressure reduction effect is realized through capillary tube 15. After heat is passed to the cold water in cold water cavity 17, the high-temperature water vapor is converted to relatively-high-temperature hot water which enters the buffer assembly 2 and pressure is further reduced, in such a way that no high-temperature water vapor or boiled water in the instantaneous heater will eject to hurt the user. The pressure relief will complete until the pressure in the heating assembly 1 is equal to the atmospheric pressure. Sudden power failure is the same as sudden water cut-off except that electronic device stops working and automatically switches off the solenoid valve 3 and the heating element 11 is completed without the intervention of an electrically controlled system to achieve ejection prevention and pressure release.

To sum up, the instantaneous heater disclosed in the present invention effectively avoids the safety problem caused by vapor rapidly erupting through throttling and pressure reduction of the capillary tube, and pressure relief of the buffer assembly.

The description above is just an embodiment according to the present invention, which doesn't constitute restriction to the scope of the present invention. Any equivalent change and modification based on Specification and the Drawings, or directly or indirectly applied in the related technical field, shall be covered within the protection scope claimed by the present invention.

What is claimed is:

1. An instantaneous heater, comprising a heating assembly, wherein the assembly comprises a heating element, a first shell, a first inlet tube, a first water outlet, a hot water cavity, a cold water cavity and a capillary tube, the hot water cavity is arranged in the first shell, the heating element is arranged in the hot water cavity, the hot water cavity communicates with the cold water cavity, the first inlet tube communicates with the cold water cavity, the first water outlet is mounted on the top of the first shell and communicates with the hot water cavity, the capillary tube is arranged in the cold water cavity, one end of the capillary tube communicates with the hot water cavity and the other end communicates with the outside of the first shell, wherein the capillary tube is a threaded type.

2. The instantaneous heater as claimed in claim 1, wherein the location where the hot water cavity communicates with the cold water cavity is near the bottom of the first shell, and the location where one end of the capillary tube communicates with the hot water cavity is near the top of the first shell.

3. The instantaneous heater as claimed in claim 1, wherein the first shell comprises a first upper cover, a first lower cover, a first outer tube and an inner tube, wherein the inner tube is arranged in the first outer tube, the first upper cover and the first lower cover are arranged on the both ends of the first outer tube or the inner tube respectively, the hot water cavity is defined by the first upper cover, the first lower cover, the first outer tube and the inner tube, the cold water cavity is defined by the first upper cover, the first lower cover and the inner tube, and one or more first through holes are arranged at the bottom of the inner tube.

4. The instantaneous heater as claimed in claim 1, wherein the water outlet of the first inlet tube is arranged on the upper part of the cold water cavity.

5. The instantaneous heater as claimed in claim 1, further comprising a temperature sensor, a liquid level sensor, a flow sensor and a heat breaker, wherein the detecting points of the temperature sensor extend into the hot water cavity and the cold water cavity respectively, the detecting points of the liquid level sensor and the heat breaker extend into the hot water cavity respectively, and the detecting point of the flow sensor extends into the first inlet tube.

6. An instantaneous heater, comprising a heating assembly, wherein the assembly comprises a heating element, a first shell, a first inlet tube, a first water outlet, a hot water cavity, a cold water cavity, a capillary tube, and a buffer assembly, wherein the hot water cavity is arranged in the first shell, the heating element is arranged in the hot water cavity, the hot water cavity communicates with the cold water cavity, the first inlet tube communicates with the cold water cavity, the first water outlet is mounted on the top of the first shell and communicates with the hot water cavity, the capillary tube is arranged in the cold water cavity, one end of the capillary tube communicates with the hot water cavity and the other end communicates with the outside of the first shell, the buffer assembly includes a second shell, a second inlet tube, a second outlet tube and an air outlet, the second inlet tube extends from the bottom of the second shell into the second shell, the water outlet of the second inlet tube is in the middle or in the upper part of the second shell, the second outlet tube extends from the top of the second shell into the second shell, the water inlet of the second outlet tube is in the lower part of the second shell, and the air outlet is arranged on the top of the second shell; the water inlet of the second inlet tube communicates with the first water outlet, the water outlet of the second inlet tube is away from the air outlet a certain distance in vertical direction, the water outlet of the first inlet tube is arranged on the upper part of the cold water cavity, and the water outlet of the second outlet tube communicates with the outside of the second shell.

7. The instantaneous heater as claimed in claim 6, wherein the water outlet of the second inlet tube is sealed, and one or more second through holes are arranged in the wall of the second inlet tube.

8. The instantaneous heater as claimed in claim 6, wherein the caliber of the air outlet is smaller than the inner diameter of the second outlet tube so that the liquid resistance generated by the air outlet toward the liquid in the second shell is sufficient to prevent the liquid from flowing out from the air outlet.

9. The instantaneous heater as claimed in claim 6, further comprising a solenoid valve, wherein the inlet of the solenoid valve communicates with the first water outlet, and the outlet of the solenoid valve communicates with the second inlet tube.

* * * * *